United States Patent [19]

Boogers

[11] 4,213,468

[45] Jul. 22, 1980

[54] METHOD AND DEVICE FOR DIVIDING TOBACCO LEAVES OR THE LIKE INTO PIECES

[75] Inventor: Wilhelmus P. L. Boogers, Eindhoven, Netherlands

[73] Assignee: B.V. Arenco P.M.B., Best, Netherlands

[21] Appl. No.: 878,398

[22] Filed: Feb. 16, 1978

[30] Foreign Application Priority Data

Mar. 31, 1977 [NL] Netherlands ..... 7703538

[51] Int. Cl.[2] ..... A24B 5/16

[52] U.S. Cl. ..... 131/145; 83/451

[58] Field of Search ..... 131/120, 122, 126, 127, 131/128–132, 125, 145, 146, 147, 149; 241/51, 60, 283, 37; 83/152, 451, 701

[56] References Cited

U.S. PATENT DOCUMENTS

| | | | |
|---|---|---|---|
| 2,293,604 | 8/1942 | Gonzalez | 131/125 |
| 2,766,759 | 10/1956 | Miller | 131/125 |
| 3,659,620 | 5/1972 | Pietrucci et al. | 131/149 |

FOREIGN PATENT DOCUMENTS

| | | | |
|---|---|---|---|
| 1540996 | 8/1968 | France | 131/145 |

*Primary Examiner*—V. Millin

*Attorney, Agent, or Firm*—John P. Snyder

[57] ABSTRACT

A method and a device for dividing tobacco leaves or the like into pieces, said pieces are suitable for effective and automatic processing, said method is distinguished in that the leaf is applied in a flat state on a supporting element and subsequently a co-operative counter-element is caused to vibrate, after which said elements are pressed together as a result of which a cutting edge provided on one of said elements is pressed across the tobacco material.

10 Claims, 1 Drawing Figure

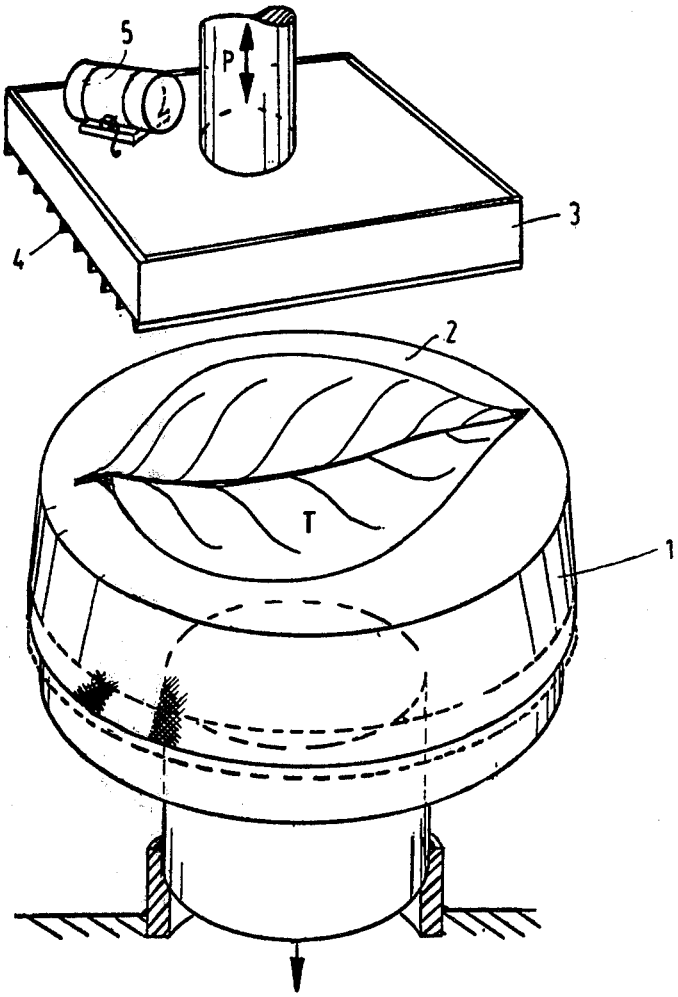
5
P
6
3
4
2
T
1

METHOD AND DEVICE FOR DIVIDING TOBACCO LEAVES OR THE LIKE INTO PIECES

The invention relates to a method and a device for dividing tobacco leaves or the like into pieces.

It is known to spread a tobacco leaf across a cutting bed comprising a standing knife, which projects above the plane of the cutting bed. Subsequently hard steel rollers are rolled along the cutting edge so that the tobacco material is cut. This method is carried out manually and has hitherto formed the best known and most effective proces. A disadvantage thereof is, however, that it is not suitable for automation.

It has furthermore been suggested to burn through the tobacco leaf by means of filaments by incandescence, but this results in a dried up edge along the cut portion of the tobacco leaf, which edge frequently gives rise to cracks during the further processing of the leaf.

The invention has for its object to provide a method in which the tobacco leaf is carefully divided up so that the resultant portions are suitable for effective processing and which method is also suitable for automatic treatment.

The method according to the invention is distinguished in that the leaf is applied in a flat state on a supporing element and subsequently a co-operative counter-element is caused to vibrate, after which said elements are pressed together as a result of which a cutting edge provided on one of said elements is pressed across the tobacco material.

Tests have shown that optimum results are obtained when the vibrations are performed only in the direction of the pressure. The frequency of the vibrations may be about 50 Hz.

This method is appropriate for automatic processing because after having been spread on the supporting element the leaf can be divided up in a single action.

The device according to the invention suitable for carrying out said method is comparatively simple because the elements need only perform a movement towards one another so that the drive can be simple.

The two elements may be provided with the cutting edge, that is to say, either the vibrated element or the counter-element. The invention proposes to provide the element without the cutting edge with an elastic supporting layer, since it has been found that owing to the vibratory movement the cutting edge does cut the tobacco material however without damaging the elastic supporting layer. This may be accounted for by the fact that the elastic supporting layer is capable of following up the vibratory movement, whereas the tobacco leaf is not.

In one embodiment the cutting edge is provided on the supporting element. The supporting element itself is constructed in the form of a suction casing, whilst the cutting edge may form the boundaries of the various suction sections of the suction casing. The tobacco leaf portions obtained can be readily separated from one another and conducted away by eliminating or maintaining the subatmospheric pressure in the suction sections.

The FIGURE shows an embodiment of a device suitable for carrying out the method in accordance with the invention. Reference numeral 1 designates a supporting element, on the top surface 2 of which is spread a tobacco leaf T.

In the embodiment shown the top surface 2 is formed by a porous, flexible skin, which can be stretched in any suitable manner along the edge of the support 1 so that the tobacco leaf T can be received in the stretched form. The support 1 itself is constructed in the form of a suction box so that the leaf T is sucked towards the porous skin 2. Opposite the supporting element 1 is arranged a counter-element 3, which is provided on the side facing the supporting element 1 with a cutting edge formed in the embodiment shown by a number of projecting strips 4 extending parallel to one another.

The counter-element 3 is provided with a vibrating aggregate 5, which is constructed so that the counter-element is caused to vibrate in up- and downward direction. By a driving mechanism (not shown) the counter-element 3 can be pressed onto the top surface 2 of the supporting element 1.

As soon as the cutting edges 4 and the leaf 2 come into contact with one another, the cutting edges will be pressed through the tobacco leaf T as a result of the superimposed movement, the approach of the counter-element 3 to the supporting element 1 by the driving mechanism and the vibratory movement by the vibrating aggregate 5. The top surface 2 is an elastically yielding layer, which can follow the vibrations of the cutting edges 4, whereas the tobacco leaf T does not follow said movements and is divided up by the cutting edges 4. The elastic supporting surface 2 is not affected.

The invention is not limited to the embodiment described above because the tobacco leaf T may, as an alternative, be sucked down by the counter-element 3, in which case the element 1 is caused to vibrate an appropriate vibration aggregate.

What is claimed is:

1. A method of dividing tobacco leaves or the like into pieces, which comprises the steps of:

(a) engaging one side of a leaf with a cutting edge while engaging the opposite side of the leaf with an elastically yielding member, to exert pressure on the leaf;

(b) maintaining the leaf, during step (a), in spread condition; and (c) relatively vibrating the cutting edge and elastically yielding member during step (a), to force the cutting edge through the leaf without affecting said elastically yielding member.

2. A method as claimed in claim 1 characterized in that the vibratory movement is performed only in the direction of pressing.

3. A method as defined in claim 2 wherein step (b) is effected by subjecting the leaf, on a side thereof, to subatmospheric pressure.

4. A method as defined in claim 1 wherein step (b) is effected by subjecting the leaf, on a side thereof, to subatmospheric pressure.

5. A device for dividing tobacco leafs and the like into pieces, comprising in combination:

cutter means for engaging one side of a leaf and elastically yielding means for engaging the other side of the leaf whereby the leaf is pressed against the cutter means; and means for effecting relative vibration between the cutter means and the elastically yielding means whereby the cutter means penetrates through the leaf without damaging the elastically yielding means.

6. A device as defined in claim 5 wherein the means last mentioned effects vibration only in the direction of pressing.

7. A device as defined in claim 6 including suction means for holding the leaf in spread state against either the cutter means or the elastically yielding means.

8. A device as defined in claim 5 including suction means for holding the leaf in spread state against either the cutter means or the elastically yielding means.

9. A device as defined in claim 5 wherein said elastically yielding means is in the form of a porous membrane and including suction means for holding the leaf in spread state against said membrane.

10. A device as defined in claim 9 wherein the means for effecting relative vibration effects vibration only in the direction of pressing.

* * * * *